United States Patent [19]

Till et al.

[11] Patent Number: 4,684,238

[45] Date of Patent: Aug. 4, 1987

[54] INTERMEDIATE TRANSFER APPARATUS

[75] Inventors: Henry R. Till, Rochester; Fredrick A. Warner, Fairport; Charles A. Radulski, Macedon, all of N.Y.

[73] Assignee: Xerox Corporation, Stamford, Conn.

[21] Appl. No.: 872,324

[22] Filed: Jun. 9, 1986

[51] Int. Cl.[4] ..... G03G 15/10

[52] U.S. Cl. ..... 355/10; 355/3 R; 355/3 TR; 355/14 TR

[58] Field of Search ..... 355/3 R, 14 R, 10, 4; 118/661, 662, 659, 61

[56] References Cited

U.S. PATENT DOCUMENTS

| | | | |
|---|---|---|---|
| 4,232,961 | 11/1980 | Masuda | 355/14 R |
| 4,420,244 | 12/1985 | Landa | 355/3 TR |
| 4,482,242 | 11/1984 | Moran et al. | 355/10 |
| 4,514,078 | 4/1985 | Béduchaud et al. | 355/3 BE |
| 4,556,309 | 12/1985 | Weber et al. | 355/3 TR |
| 4,559,509 | 12/1985 | Mayer | 355/3 TR |
| 4,560,268 | 12/1985 | Nishimura | 355/3 R |
| 4,607,940 | 8/1986 | Quang | 355/10 X |
| 4,623,240 | 11/1986 | Kimura et al. | 355/10 |

*Primary Examiner*—A. C. Prescott

*Attorney, Agent, or Firm*—H. Fleischer; J. E. Beck; R. Zibelli

[57] ABSTRACT

An apparatus in which a plurality of liquid images are transferred from a photoconductive member to a copy sheet. The liquid images, which include a liquid carrier having toner particles dispersed therein, are attracted from the photoconductive member to an intermediate belt. Liquid carrier is moved from the intermediate belt and the toner particles are compacted thereon in image configuration. Thereafter, the toner particles are transferred from the intermediate belt to the copy sheet in image configuration.

10 Claims, 2 Drawing Figures

INTERMEDIATE TRANSFER APPARATUS

Figure 1:
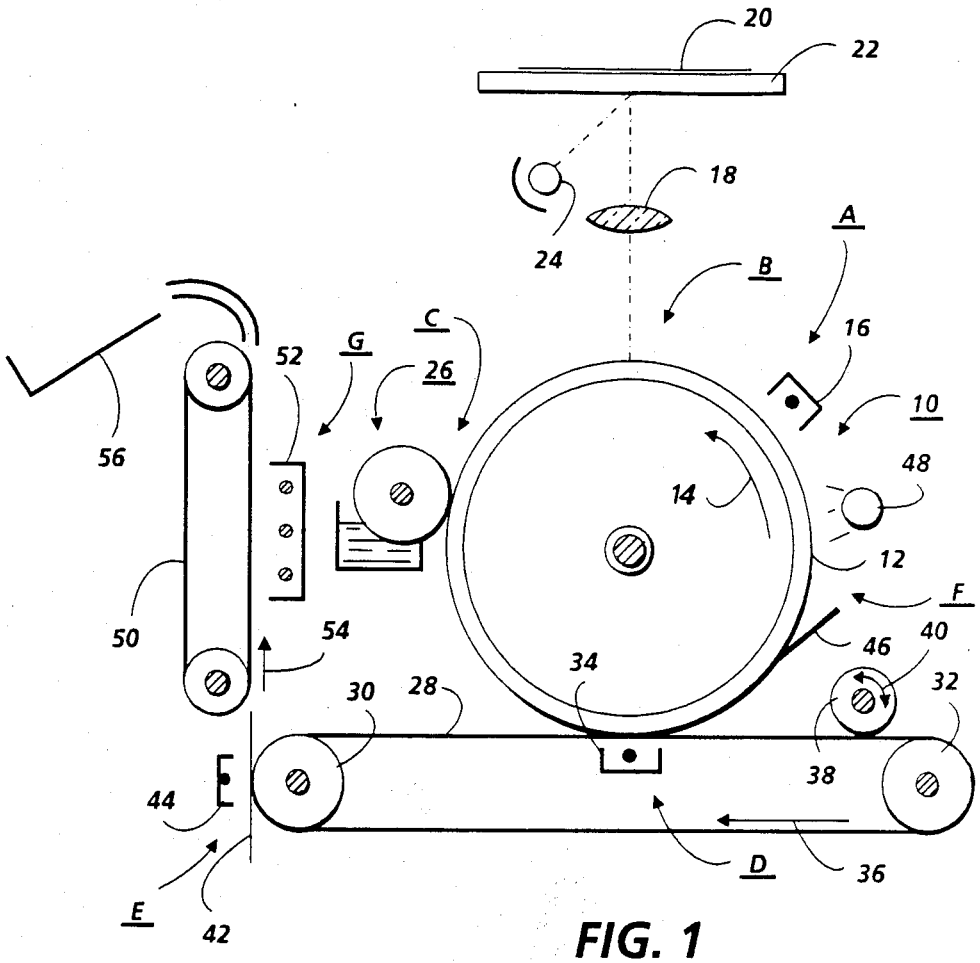

This invention relates generally to an electrostatographic printing machine, and more particularly concerns an apparatus for transferring a liquid image having at least a liquid carrier with toner particles from a photoconductive member to a copy sheet.

In electrophotographic printing, a charged photoconductive member is exposed to a light image of an original document. The irradiated area of the photoconductive surface is charged to record an electrostatic latent image thereon corresponding to the informational area contained within the original document. Generally, the electrostatic latent image is developed by bringing a developer mixture into contact therewith. A dry developer mixture usually comprises carrier granules having toner particles adhering triboelectrically thereto. Toner particles are attracted from the carrier granules to the latent image forming a toner powder image thereon. Alternatively, a liquid developer material may be employed. The liquid developer material includes a liquid carrier having toner particles dispersed therein. The liquid developer material is advanced into contact with the electrostatic latent image and the toner particles are deposited thereon in image configuration. After the toner particles have been deposited on the photoconductive surface, in image configuration, it is transferred to a copy sheet. Generally, when a liquid developer material is employed, the copy sheet is wet with both the toner particles and the liquid carrier. Thus, it becomes necessary to remove the liquid carrier from the copy sheet. This may be accomplished by drying the copy sheet prior to fusing the toner particles thereto or relying upon the fusing process to permanently fuse the toner particles to the copy sheet as well as vaporizing the liquid carrier adhering thereto. Clearly, it is desirable to refrain from transferring any liquid carrier to the copy sheet. Thus, it is advantageous to transfer the developed image to an intermediate web or belt and subsequently remove the liquid carrier therefrom prior to the transfer of the toner particles to the copy sheet. The following disclosures appear to be relevant:

U.S. Pat. No. 4,232,961,
Patentee: Masuda,
Issued: Nov. 11, 1980,
U.S. Pat. No. 4,420,244,
Patentee: Landa,
Issued: Dec. 13, 1983,
U.S. Pat. No. 4,514,078,
Patentee: Beduchaud et al.,
Issued: Apr. 30, 1985,
U.S. Pat. No. 4,556,309,
Patentee: Weber et al.,
Issued: Dec. 3, 1985,
U.S. Pat. No. 4,559,509,
Patentee: Mayer,
Issued: Dec. 17, 1985,
U.S. Pat. No. 4,560,268,
Patentee: Nishimura,
Issued: Dec. 24, 1985.

The relevant portions of the foregoing patents may be briefly summarized as follows:

Masuda discloses the use of an image transfer contact roller which urges the image transfer belt against the photoreceptor drum. The contact roller is comprised of two rollers, along with a charger interposed between the rolls.

Landa describes the use of a reverse roller which reduces the excess liquid on the developed image before transfer and also acts as a metering device with a biased potential applied thereon.

Beduchaud et al. discloses the use of a potential difference between an auxiliary roller and a pressure roller to facilitate image transfer.

Weber et al. describes an intermediate transfer medium which is brought into intimate contact with an electrophotographic member to facilitate the transfer of toner pigments by the use of a high intensity electrical field.

Mayer discloses a double potential bias system which improves the transferring capability between a transfer roller and a photoconductive drum.

Nishimura discloses a restart roller and a toner recovery roller. The restart roller has a discharge lamp or charger which attenuates the holding force of the electrostatic charges which define the electrostatic image on the photoconductive drum. This allows the smooth transfer of the toner image to the transfer sheet.

In accordance with one aspect of the present invention, there is provided an apparatus for transferring a liquid image having at least a liquid carrier with toner particles dispersed therein from the member to the copy sheet. The apparatus includes an intermediate member positioned to have at least a portion thereof contacting the member in a transfer zone. Means, located in the transfer zone, attract the liquid image from the member to the intermediate member. Means are provided for removing liquid carrier from the intermediate member and compacting the toner particles thereon in image configuration. Means transfer the toner particles from the intermediate member to the copy sheet in image configuration.

Pursuant to another aspect of the features of the present invention, there is provided an electrophotographic printing machine of the type having a liquid image of liquid carrier with toner particles dispersed therein formed on a photoconductive member. An intermediate member is positioned to have at least a portion thereof contacting the photoconductive member in a transfer zone. Means, located in the transfer zone, attract the liquid image from the photoconductive member to the intermediate member. Means remove liquid carrier from the intermediate member and compact the toner particles thereon in image configuration. Means are provided to transfer the toner particles from the intermediate member to the copy sheet in image configuration.

Figure 2:
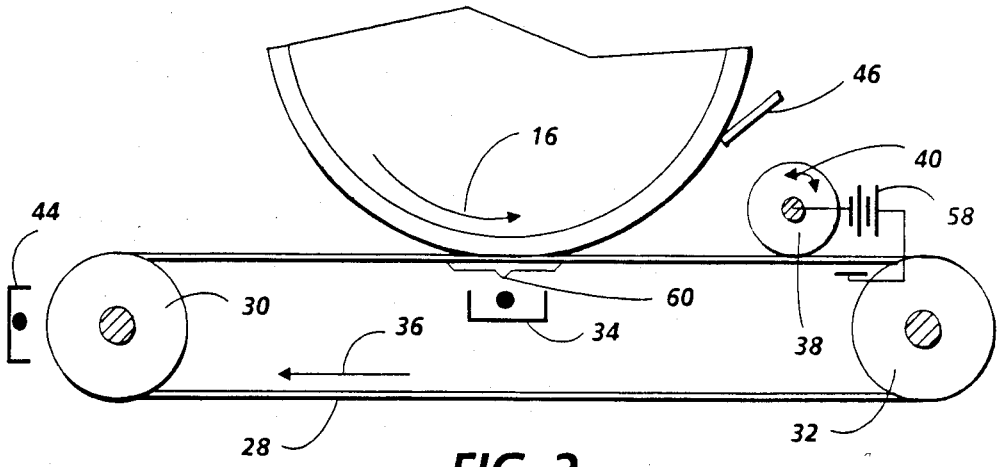

Other aspects of the present invention will become apparent as the following description proceeds and upon reference to the drawings, in which:

FIG. 1 is a schematic elevational view showing an illustrative electrophotographic printing machine incorporating the features of the present invention therein; and FIG. 2 is an elevational view depicting the transfer apparatus used in the FIG. 1 printing machine.

While the present invention will hereinafter be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

For a general understanding of the features of the present invention, reference is made to the drawings. In the drawings, like reference numerals have been used throughout to designate identical elements. FIG. 1 is a schematic elevation view illustrating the electrophotographic printing machine incorporating the features of the present invention therein. It will become apparent from the following discussion that the apparatus of the present invention may be equally well suited for use in a wide variety of printing machines and is not necessarily limited in this application to the particular embodiment shown herein.

Turning now to FIG. 1, the electrophotographic printing machine employs a photoconductive member having a drum 10 mounted rotatably within the printing machine. The photoconductive surface 12 is mounted on the exterior circumferential surface of drum 10 and entrained thereabout. A series of processing stations are positioned about drum 10 such that as drum 10 rotates in the direction of arrow 14, it passes sequentially therethrough. Drum 10 is driven at a predetermined speed relative to the other machine operating mechanisms by a drive motor. Timing detectors sense the rotation of drum 10 and communicate with the machine logic to synchronize the various operations thereof with the rotation of drum 10. In this manner, the proper sequence of events is produced at the respective processing stations.

Drum 10 initially rotates the photoconductive surface 12 through charging station A. At charging station A, a corona generating device, indicated generally by the reference numeral 16 sprays ions onto photoconductive surface 12 producing a relatively high, substantially uniform charge thereon.

Next, the charged photoconductive surface is rotated on drum 10 to exposure station B. At exposure station B, a light image of an original document is projected onto the charged portion of the photoconductive surface 12. Exposure station B is a moving lens system, generally designated by the reference numeral 18. An original document 20 is positioned face down upon a generally planar, substantially transparent platen 22. Lamps 24 are adapted to move in a timed relationship with lens 18 to scan successive incremental areas of original document 20. In this manner, a flowing light image of original document 20 is projected onto the charged portion of photoconductive surface 12. This selectively dissipates the charge on photoconductive surface 12 to record an electrostatic latent image thereon corresponding to the informational areas in original document 20. While a light lens system has heretofore been described, one skilled in the art will appreciate that other techniques, such as a modulated laser beam may be employed to selectively discharge the charged portion of the photoconductive surface to record the electrostatic latent image thereon.

After exposure, drum 10 rotates the electrostatic latent image recorded on photoconductive surface 12 to development station C. Development station C includes a developer unit, generally indicated by the reference numeral 26. Developer unit 26 includes a roller adapted to advance the liquid developer material into contact with the electrostatic latent image recorded on photoconductive surface 12. By way of example, the liquid developer material comprises an insulating carrier material made from an aliphatic hydrocarbon, largely decane, which is manufactured by the Exxon Corporation, under the trademark Isopar having toner particles dispersed therein. Preferably, the toner particles are made predominantly from a pigmented material such as a suitable resin. A suitable liquid developer material is described in U.S. Pat. No. 4,582,774 issued Landa in 1986, the relevant portions thereof being hereby incorporated into the present application. The developed electrostatic latent image is transported on drum 10 to transfer station D.

At transfer station D, the developed liquid image is electrostatically transferred to an intermediate member or a belt indicated generally by the reference numeral 28. Belt 28 is entrained about spaced rollers 30 and 32, respectively. Belt 28 moves in the direction of arrow 36. A corona generating device, indicated generally by the reference numeral 34, sprays ions onto the backside of belt 28 to attract the liquid developed image thereto. As belt 28 advances in the direction of arrow 36, the liquid image transferred thereto advances to metering roller 38. Metering roller 38 rotates either clockwise or counter clockwise, as indicated by arrow 40, and is electrically biased. The gap between metering roller 38 and belt 28 results in removing liquid carrier from belt 28. An electrical bias is applied on metering roller 38 to repel toner particles toward belt 28. Thus, the liquid carrier is removed from belt 28 with the toner particles adhering thereto being compacted in image configuration. Further details of the transfer system will be described hereinafter with reference to FIG. 2.

With continued reference to FIG. 1, the compacted toner particles are advanced on belt 28, in the direction of arrow 36, to transfer station E. At transfer station E, copy sheet 42 is advanced, in synchronism, with the toner particle image on belt 28. Transfer station E includes a corona generating device 44 which sprays ions onto the backside of copy sheet 42. This attracts the toner particles from belt 28 to copy sheet 42 in image configuration.

Invariably, some residual liquid carrier and toner particles remain adhering to photoconductive surface 12 of drum 10 after the transfer thereof to belt 28. These residual particles and liquid carrier are removed from photoconductive surface 12 at cleaning station F. Cleaning station F includes a flexible, resilient blade 46. This blade has the free end portion thereof in contact with photoconductive surface 12 to remove any material adhering thereto. Thereafter, lamp 48 is energized to discharge any residual charge on photoconductive surface 12 preparatory for the next successive imaging cycle.

After the toner particles are transferred to copy sheet 42, the copy sheet advances on conveyor 50 through fusing station G. Fusing station G includes a radiant heater 52 which radiates sufficient energy to permanently fuse the toner particles to the copy sheet 42 in image configuration. Conveyor belt 50 advances the copy sheet, in the direction of arrow 54, through radiant fuser 52 to catch tray 56. When copy sheet 42 is located in catch tray 56, it may readily removed therefrom by the machine operator.

The foregoing describes generally the operation of the electrophotographic printing machine including the transfer apparatus of the present invention therein. The detailed structure of the transfer apparatus will be described hereinafter with reference to FIG. 2.

Referring now to FIG. 2, drum 10 contacts belt 28 in transfer zone 60. Corona generating device 34 sprays ions onto the backside of belt 28, in transfer zone 60, to attract the developed liquid image thereto. After the liquid image is transferred to belt 28, it passes beneath metering roller 38. Voltage source 58 electrically biases metering roller 38. Thus, metering roller 38 is highly charged to a magnitude and polarity sufficient to hold the toner particles on belt 28 and remove the liquid carrier adhering thereto. The positioning of roller 38 with respect to belt 28 defines a gap therebetween. Thus, as the toner particles adhering to belt 28 pass into the gap defined between metering roller 38 and belt 28, the toner particles are compacted. Substantially simultaneously, the liquid carrier is removed from belt 36. Preferably, metering roller 38 is made from a an electrically conductive metal material. By way of example, metering roller 38 is suitable to advance the liquid carrier attracted thereto away from belt 28. A resilient scraping blade (not shown) removes the liquid carrier from metering roller 38. In this way, the liquid carrier is removed from belt 28 and the toner particles compacted thereon prior to the transfer of the toner particles to the copy sheet. Thus, the copy sheet remains substantially dry, and is not wetted by the liquid carrier. After the liquid carrier is removed from belt 28 and the toner particles compacted thereon, in image configuration, belt 28 advances the compacted toner particles to transfer station E.

At transfer station E, corona generating device 44 sprays ions on to the backside of copy sheet 42 to attract the compacted toner particles to the copy sheet in image configuration. By way of example, belt 28 is made from a flexible, highly insulating polymer. A typical belt material is a polyester web such as polyethylene terephthatic available from E. I. DuPont de Nemours and Company, Inc. under the tradename Mylar or any other suitable polypropylene material.

In recapitulation, it is clear that an intermediate belt is employed to receive a developed liquid image from a photoconductive member. The liquid carrier is removed from the intermediate belt by a highly charged metering roller. The metering roller not only removes the liquid carrier but also compacts the toner particles on the intermediate belt in image configuration. After the liquid carrier has been removed from the intermediate belt, the compacted toner particles are transferred to a copy sheet in image configuration, in this way, the copy sheet remains substantially dry and the liquid carrier does not wet the surface thereof.

It is, therefore, apparent that there has been provided, in accordance with the present invention, an apparatus for transferring a liquid image to an intermediate belt and transferring the resultant toner particles to a copy sheet in image configuration. This apparatus fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations as fall within the spirit and broad scope of the appended claims.

We claim:

1. An apparatus for transferring a liquid image having at least a liquid carrier with toner particles dispersed therein from a member to a copy sheet, including:

an intermediate member positioned to have at least a portion thereof contacting the member in a transfer zone;

means, located in the transfer zone, for atracting the liquid image from the member to said intermediate member;

means for removing liquid carrier from said intermediate member and compacting the toner particles thereon in image configuration; and means for transferring the toner particles from said intermediate member to the copy sheet in image configuration.

2. An apparatus according to claim 1, wherein said removing and compacting means includes:

a roller positioned closely adjacent said intermediate member to compact the toner particles thereon; and means for electrically biasing said roller to repel toner particles toward said intermediate member and to remove liquid carrier therefrom.

3. An apparatus according to claim 2, wherein said intermediate member is a belt.

4. An apparatus according to claim 5, wherein said attracting means includes a corona generator positioned in the transfer zone adjacent said belt on the side thereof opposed from said member.

5. An apparatus according to claim 4, wherein said transferring means includes a corona generator positioned adjacent said copy sheet on the side thereof opposed from said belt.

6. An electrophotographic printing machine of the type having a liquid image of liquid carrier with toner particles dispersed therein formed on a photoconductive member, including:

an intermediate member positioned to have at least a portion thereof contacting the photoconductive member in a transfer zone;

means, located in the transfer zone, for attracting the liquid image from the photoconductive member to said intermediate member;

means for removing liquid carrier from said intermediate member and compacting the toner particles thereon in image configuration; and means for transferring the toner particles from said intermediate member to the copy sheet in image configuration.

7. A printing machine according to claim 6, wherein said removing and compacting means includes:

a roller positioned closely adjacent said intermediate member to compact the toner particles thereon; and means for electrically biasing said roller to repel toner particles toward said intermediate member and to remove liquid carrier therefrom.

8. A printing machine according to claim 7, wherein said intermediate member is a belt.

9. A printing machine according to claim 8, wherein said attracting means includes a corona generator positioned in the transfer zone adjacent said belt on the side thereof opposed from said photoconductive member.

10. A printing machine according to claim 9, wherein said transferring means includes a corona generator positioned adjacent said copy sheet on the side thereof opposed from said belt.

* * * * *